US006002774A

United States Patent [19]

Aarts et al.

[11] Patent Number: 6,002,774

[45] Date of Patent: Dec. 14, 1999

[54] ARRANGEMENT, A SYSTEM, A CIRCUIT AND A METHOD FOR ENHANCING A STEREO IMAGE

[75] Inventors: Ronaldus M. Aarts; Paul A. C. Beijer; Robertus T. J. Toonen Dekkers, all of Eindhoven, Netherlands

[73] Assignee: U.S. Phillips Corporation, New York, N.Y.

[21] Appl. No.: 08/959,347

[22] Filed: Oct. 28, 1997

[30] Foreign Application Priority Data

Nov. 8, 1996 [EP] European Pat. Off. ..... 96203131

[51] Int. Cl.[6] ..... H04R 5/00

[52] U.S. Cl. ..... 381/1; 381/10

[58] Field of Search ..... 381/1, 22, 10, 381/11, 2, 17, 18, 13

[56] References Cited

U.S. PATENT DOCUMENTS

| | | | |
|---|---|---|---|
| 4,696,036 | 9/1987 | Julstrom | 381/22 |
| 4,866,774 | 9/1989 | Klayman | 381/1 |
| 5,432,854 | 7/1995 | Honjo et al. | 381/10 |
| 5,671,286 | 9/1997 | Gottfried et al. | 381/10 |
| 5,742,687 | 4/1998 | Aarts | 381/1 |

FOREIGN PATENT DOCUMENTS

0664661A1 1/1995 European Pat. Off. ..... H04S 1/00

OTHER PUBLICATIONS

"DvR's Latest: The Analog Bass Computer" by Gary Stock, Audio, vol. 65, No. 2, p. 24, Feb. 1981, (New York).

"Dolby HX Pro", Audio, vol. 68, No. 11, p. 31, Nov. 1984.

"Dynamic Bias Control With HX Professional", by J. Selmer Jensen and S.K. Pramanik, Audio, vol. 68, No. 8, p. 34, p. 36–p. 41, Aug. 1984, (New York).

*Primary Examiner*—Vivian Chang

*Attorney, Agent, or Firm*—Edward W. Goodman

[57] ABSTRACT

A stereophonic audio signal processing arrangement for variably enhancing a stereo image, wherein the stereo image enhancement is reduced at high signal levels so as to reduce distortion. The arrangement is used in a stereophonic audio reproduction system for enhancing the stereo image, which system may be part of an audio-visual reproduction system.

9 Claims, 3 Drawing Sheets

ARRANGEMENT, A SYSTEM, A CIRCUIT AND A METHOD FOR ENHANCING A STEREO IMAGE

BACKGROUND OF THE INVENTION

1. Field of the Invention

The invention relates to a stereophonic audio signal processing arrangement comprising:

signal processing means, including a stereo enhancement circuit for processing a stereo input signal, signal amplifying means for amplifying a stereo output signal supplied by the signal processing means, said stereo enhancement circuit comprising:

first means having a first and a second input for receiving a left channel and a right channel signal of the stereo input signal and a first and a second output for supplying a left channel and a right channel signal of a stereo signal having an enhanced stereo image, and second means for controllably combining the stereo input signal and the stereo output signal of the first means for varying the stereo image enhancement.

The invention further relates to a stereophonic audio reproduction system including such a stereophonic audio signal processing arrangement, and left channel and right channel loudspeakers for reproducing the amplified stereo signal supplied by the signal amplifying means.

The invention also relates to an audio-visual reproduction system including such a stereophonic audio reproduction system, a cabinet in which a picture display screen and the left channel and right channel loudspeakers are installed.

The invention relates to a stereo enhancement circuit.

The invention also relates to a method for enhancing a stereo image of a stereo input signal, comprising the steps of:

generating a stereo output signal having an enhanced stereo image from the stereo input signal, and controllably combining the stereo input signal and the stereo output signal to provide a processed stereo output signal.

2. Description of the Related Art

Such an arrangement, such systems and such a circuit are known from the European Patent Application EP-A 664661, corresponding to U.S. patent application Ser. No. 08/371,187, filed Jan. 1, 1995, now U.S. Pat. No. 5,742,687. In the known arrangement the enhanced stereo signal can be mixed with the input stereo signal, for example, in a ratio $(1-\alpha):\alpha$. By varying a between 0 and 1, the amount of stereo image enhancement can be varied from conventional, or normal, stereo to fully enhanced stereo. A drawback of the known stereo image enhancement is that the amplitude of the enhanced stereo signal can be more than 10 dB larger than the amplitude of the normal, unenhanced, stereo signal, even though the loudness of the resulting acoustical signals is perceived as substantially the same. At high signal levels, this larger amplitude of the enhanced stereo signal may give rise to distortion in an amplifier following the arrangement.

SUMMARY OF THE INVENTION

An object of the present invention is to provide an arrangement which produces less distortion than the known arrangement.

An arrangement according to the invention is characterized in that the stereo enhancement circuit comprises control means coupled to the second means for controlling the combining of the stereo signals so as to reduce the stereo image enhancement at high signal levels. The invention is based on the recognition that a reduction of the stereo image enhancement of the stereo signal usually results in a reduction of the amplitude of each of the left channel and right channel signals of the enhanced stereo signal. By reducing the stereo image enhancement at high signal levels, distortion can be significantly reduced, as now the amplifier will receive signals with a reduced amplitude compared to signals having the full stereo image enhancement.

An embodiment of the invention is characterized in that the arrangement comprises volume level setting means supplying a signal representative of a volume level to the amplifying means for setting the volume level, and to the control means for controlling the combining as a function of the set volume level. The actual or set volume level of the arrangement can be used as an indication that high signal levels can be expected. By reducing the stereo image enhancement at high volume levels, i.e., as a function of the set volume level, a simple implementation of the control means is achieved without the need for measuring the actual signal levels.

A further embodiment of the invention is characterized in that the control means comprises means for comparing the signal level of the amplified stereo output signal with a reference level, and for supplying a control signal to the second means for reducing the stereo image enhancement when the signal level exceeds the reference level. By measuring the actual output signals of the amplifying means, it is possible to accurately determine if distortion is present, e.g., when the signal level exceeds a level above which the amplification becomes non-linear. This level is represented by the threshold.

A further embodiment of the invention is characterized in that the control means comprises means for comparing the signal level of the stereo output signal of the second means with a reference level, and for supplying a control signal to the second means for reducing the stereo image enhancement when the signal level exceeds the reference level. An alternative to measuring the signal level of the output signals of the amplifying means is to measure the signal level of the output signals of the second means which are to be supplied to the amplifying means. Now the control means does not need to process signals having a large amplitude resulting from the amplification by the amplifying means.

A further embodiment of the invention is characterized in that the reference level is a function of the set volume level. Headroom is the amount of extra amplification that a signal may undergo before being distorted by the amplifying means. The set volume level gives an indication of how much headroom the amplifier still has. As the volume control is normally located behind the stereo enhancement circuit, the set volume level can serve as the reference level, indicating when the stereo image enhancement should be reduced in order to avoid distortion.

A further embodiment of the invention is characterized in that the control signal is only generated if at least one of the left channel and right channel output signals of the second means exceeds the associated left channel or right channel input signal of the first means. By using this measure, the stereo image enhancement reduction only takes place if it can have a positive effect. If the output signals of the second means do not exceed the input signals of the first means, then a reduction of the stereo image enhancement will have no positive effect on distortion and the reduction should not be done at all in order to avoid any possibly detrimental effects of such a reduction.

BRIEF DESCRIPTION OF THE DRAWINGS

The above object and features of the present invention will be more apparent from the following description of the preferred embodiments with reference to the drawings, wherein.

DESCRIPTION OF THE PREFERRED EMBODIMENTS

Figure 1:
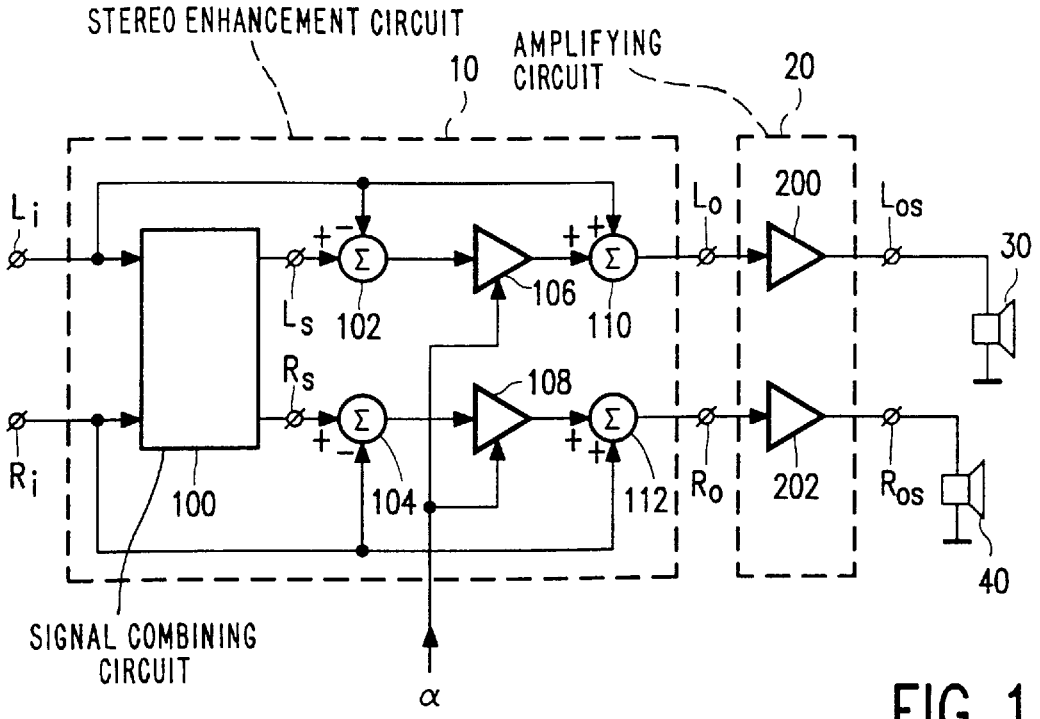
FIG. 1 PRIOR ART
FIG. 1 shows an embodiment of a known stereophonic audio reproduction system.

FIG. 1 shows an embodiment of a known stereophonic audio reproduction system. The stereophonic audio reproduction system comprises a stereophonic processing arrangement including a stereo enhancement circuit 10 for processing a left channel and right channel input signals Ri and Li into left channel and right channel output signals Lo and Ro, respectively, and amplifying means 20 for amplifying and supplying the left channel and right channel output signals Lo and Ro to respective left channel and right channel loudspeakers 30 and 40. Such a system is, in principle, known from EP-A 664661. The stereo enhancement circuit 10 comprises first means 100, having a first input for receiving the left channel input signal Li, a second input for receiving the right channel input signal Ri, a first output for providing a left channel signal Ls, and a second output for providing a right channel signal Rs. The left and right channel signals Ls and Rs have an enhanced stereo image as compared to the signals Li and Ri. For a more detailed description of the first means 100, reference is made to EP-A 664 661. The stereo enhancement circuit 10 further comprises second means for controllably combining the left channel signals Li and Ls and the right channel signals Ri and Rs. The second means comprises:

first and second subtractors 102 and 104 for providing the subtracted pairs of signals Li-Ls, and Ri-Rs, respectively, to respective controllable attenuators 106 and 108, each having a controllable gain equal to $\alpha$, wherein $0 \leqq \alpha \leqq 1$, and third and fourth adders 110 and 112 for adding the output signal of the first and second controllable attenuators 106 and 108 to signals Li and Ri, thereby providing the left channel and right channel output signals Lo and Ro. In this way the output signals Lo and Ro are formed according to the formulas:

$$Lo=\alpha*Ls+(1-\alpha)*Li$$

$$Ro=\alpha*Rs+(1-\alpha)*Ri.$$

By varying parameter $\alpha$ between 0 and 1 the stereo effect in the output signal formed by left channel and right channel signals Lo and Ro can be varied between a normal, i.e., conventional, stereo image for $\alpha=0$, to a fully enhanced stereo image for $\alpha=1$. The second means can be implemented in other ways as well, for example, by providing separate controllable attenuators for each of the signals Li, Ri, Ls and Rs, having respective controllable gains of $(1-\alpha)$, $(1-\alpha)$, $\alpha$ and $\alpha$, and adding the resulting pairs of attenuated signals Li, Ls, and Ri, Rs.

For a <>0, the amplitude of each of the resulting signals Lo and Ro can be larger than the original signals Li and Ri. This difference may be as high as 12 dB or more. This is due to the fact that the stereo image enhancement is achieved by adding a significant amount of negative cross-talk to the left and right channels. When reproduced by loudspeakers, a part of these signals is acoustically cancelled as a result. The extra 12 dB gain is necessary to achieve substantially the same sound level as for normal stereo. This means that for reproduction of stereo signals having an enhanced stereo image, the amplifying means which amplifies such signals as well as the loudspeakers that reproduce these signals should have a larger dynamic range than required for normal stereo signals.

Figure 2:
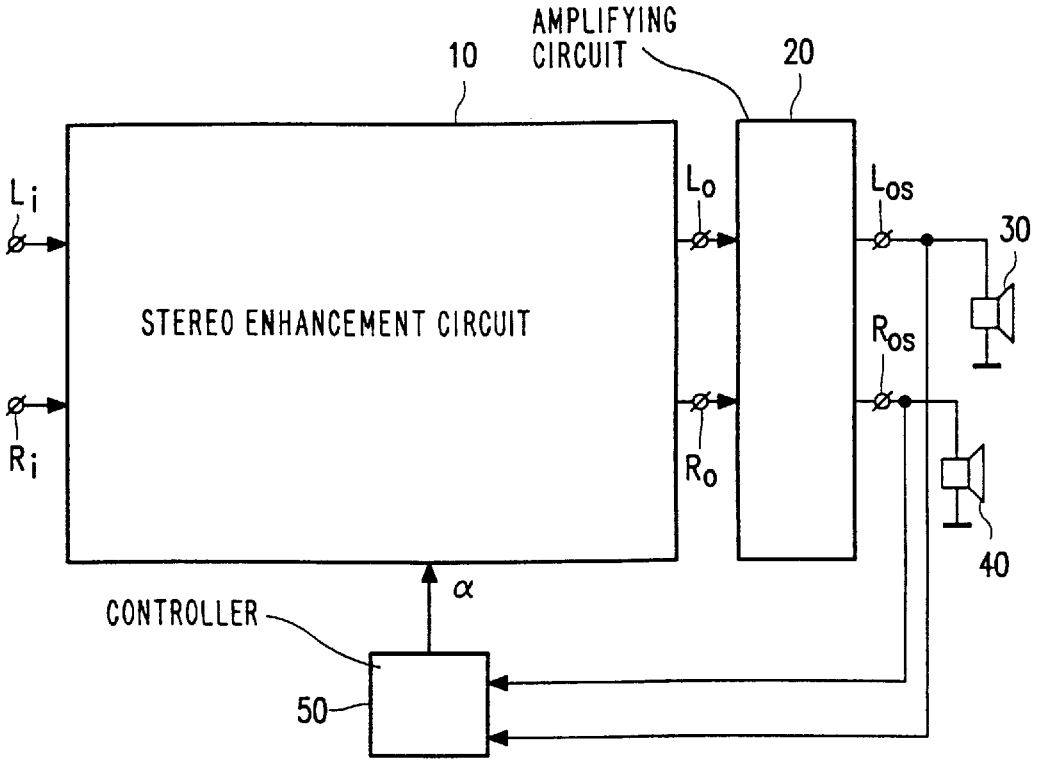
FIG. 2 shows a first embodiment of a stereophonic audio reproduction system according to the invention.

FIG. 2 shows a first embodiment of a stereophonic audio reproduction system according to the invention. FIG. 2 differs from FIG. 1 in that control means 50 have been added, the control means 50 receiving, as input signals, the left channel and right channel output signals Los and Ros of the amplifying means 20, and supplying a control signal representing $\alpha$ to the signal enhancement circuit 10 for controlling the stereo image enhancement. The control means 50 are used for controlling the combining of the stereo signals so as to reduce the stereo image enhancement at high signal levels. When either signal Los or Ros exceeds a threshold value, the control signal $\alpha$ supplied by the control means 50 is reduced accordingly. This threshold value is the value of the output signal above which the amplification of the amplifying means 20 becomes non-linear. An advantage of this embodiment is that the control signal $\alpha$ is directly derived from the signals undergoing distortion.

Figure 3:
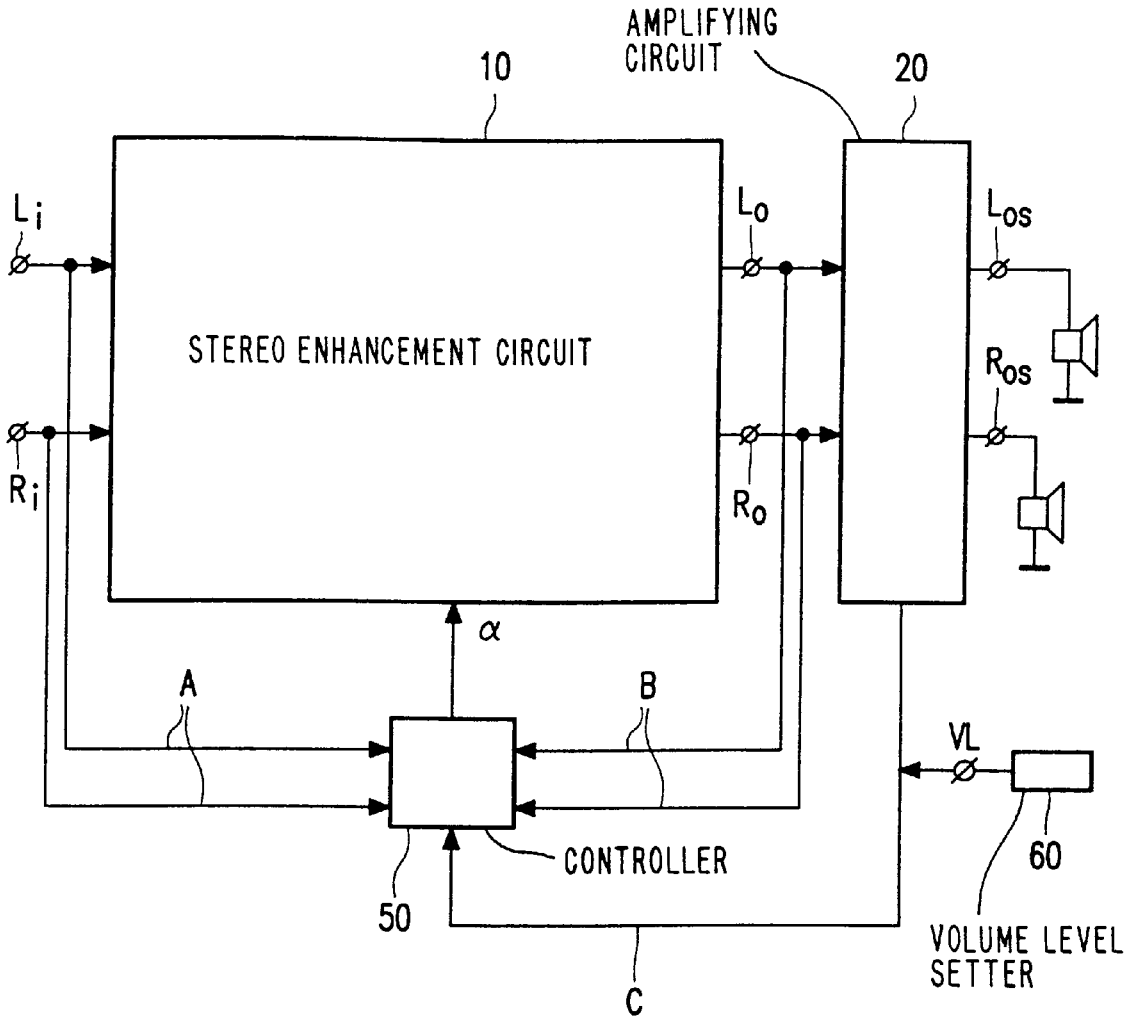
FIG. 3 shows a second embodiment of a stereophonic audio reproduction system according to the invention.

FIG. 3 shows a second embodiment of a stereophonic audio reproduction system according to the invention. FIG. 3 differs from FIG. 2 in that volume level setting means 60 are added, and in that the control means 50 now receive three groups A, B and C, of input signals, instead of one group of signals. Group A comprises the left channel and right channel input signals Li and Ri, group B comprises the left channel and right channel output signals Lo and Ro of the signal enhancement circuit 10, and group C comprises a signal VL representative of the volume level setting. The volume level setting means 60 supplies a signal VL representative of the volume level setting to the amplifying means 20 for setting the volume level. For this purpose, the amplifiers of the amplifying means 20 each have a controllable gain, the gain being controlled by said signal VL. The groups A, B and C can be used separately or in combination with each other for generating the control signal $\alpha$. When only the group A and group C signals are used, the control means 50 calculates from the set volume level, the maximum level of an input signal applied to the amplifying means above which maximum level or threshold, the amplification becomes non-linear. This threshold value is reduced by 12 dB to take into account the extra signal level needed for reproducing the enhanced stereo signals. If the level of the input signal exceeds this maximum level or threshold, then the control means 50 reduce $\alpha$ accordingly. When only the group B and group C signals are used, the control means 50 differs only from the control means 50 used for group A and group C signals in that it is no longer necessary to deduct the 12 dB from the maximum level as now the output signals of the stereo enhancement circuit 10 are used instead of its input signals. If the volume level adjustment is made before the stereo enhancement circuit 10, the signal VL need not be used as the maximum level or threshold can now have a fixed value. In this case, the group C signal can be dispensed with. The correction, or reduction, of a need only be of the amount required to avoid this distortion. For example, when a reduction of signal level of only 6 dB is needed, α need only be reduced to 0.5. It is also possible to use only the group C signal, i.e., the signal VL representative of the set volume level. This results in a very simple solution for the control means 50 as no signal measurements take place. α will now be reduced if the set volume level is so high that an input signal having a maximum allowed signal level will undergo distortion. Of course, the 12 dB extra margin is taken into account here as well. However, this means that a may be reduced even if no distortion takes place, i.e., if the actual signal level remains below the threshold.

Figure 4:
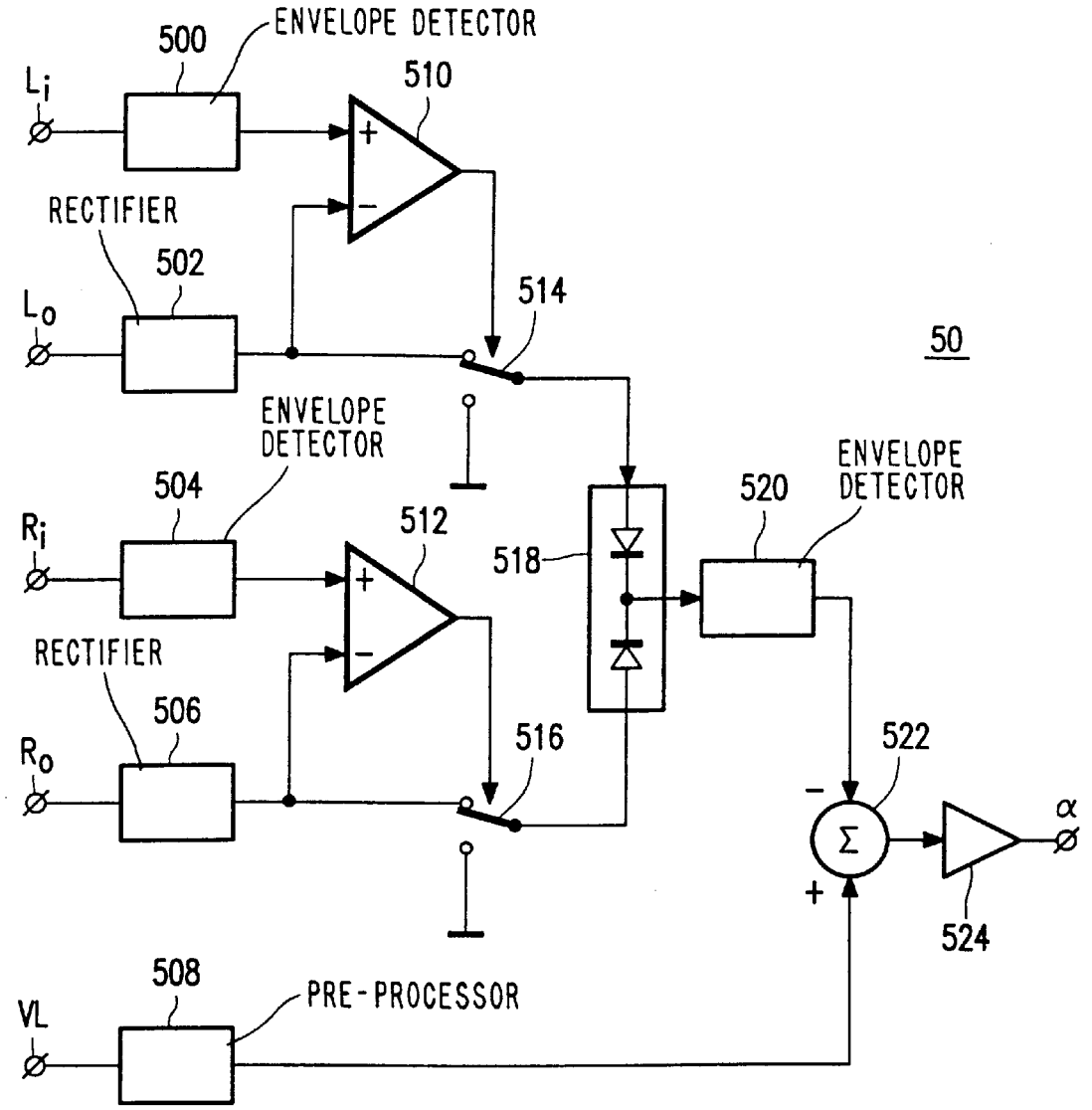
FIG. 4 shows an embodiment of control means for use in the present invention.

FIG. 4 shows an embodiment of control means for use in the present invention. The control means 50 is an improvement on the control means 50 discussed in connection with FIG. 3. In the control means 50 of FIG. 4, all three groups A, B and C are used for generating the control signal α. The control means 50 comprises first to fifth preprocessing means 500, 502, 504, 506 and 508, first and second comparators 510 and 512, first and second controlled switches 514 and 516, adding means 518, envelope detector 520, subtracting means 522 and amplifying means 524. The first comparator 510, together with the first and second preprocessing means 500 and 502 and the first controlled switch 514, act as a selective peak detector to pass on to the adding means 518 only those peaks in the Lo signal which exceed the envelope of the Li signal. For this purpose, the signal Li is applied to the positive input of the first comparator 510 via preprocessing means 500, in this case an envelope detector. The signal Lo is applied to both the controllable switch 514 and the negative input of the comparator 510 via preprocessing means 502, in this case, a rectifier. When peaks in the rectified signal of Lo exceed the envelope of signal Li, the first comparator 510 activates the controlled switch 514 and the rectified signal Lo will be passed on to the adding means 518. A similar processing of the signals Ri and Ro is performed by the second comparator 512, together with the third and fourth preprocessing means 504 and 506 and the second controlled switch 516. In this example, the preprocessing means 504 comprises an envelope detector and the preprocessing means 506 comprises a rectifier. In the adding means 518, the larger of the two signals applied to the adding means 518 is passed on to an envelope detector 520. The output signal of envelope detector 520 is then subtracted, in subtracting means 522, from the output signal of pre-processing means 508 which receives the signal VL, which is, in its turn, representative of the set volume level. The signal resulting from the subtraction is then amplified by amplifying means 524 and is the control signal α to be supplied to the stereo enhancement circuit 10 of FIG. 3. The signal derived from signal VL is a threshold above which the amplification in the amplifying means 20 becomes non-linear. This signal may be derived from VL as follows. At a given volume level setting, it is determined, experimentally or theoretically, at what amplitude an input signal supplied to the amplifying means 20 will be amplified non-linearly. This results in a threshold which may not be exceeded by input signals at that given volume level setting. At a new (different) volume level setting, this threshold can be recalculated using the difference between the given volume level setting and the new volume level setting. Thus, when the new volume level setting is 6 dB lower, the threshold should be increased, correspondingly, by 6 dB. In this way, the peak values of the signals Lo and Ro reduce the value of α when these peak values exceed the threshold. The use of the selective peak detectors ensure that α is only reduced when it will have an effect, i.e., when the signals Lo and Ro have larger amplitudes than the signals Li and Ri. If this were not done, α would be reduced even when it does not have any positive effect on distortion reduction. It may even be so that for some input signals, a reduction of α can result in an increase of the output signal level. This depends on the phase difference between the left and right channel input signals. This effect could result in an unstable feedback loop, but is avoided when the selective peak detectors as described previously are used. These selective peak detectors may also be used advantageously in the control means 50 of FIG. 2 for prohibiting the reduction of α when no beneficial effect can be expected from this reduction. The preprocessing means 500, 502, 504 and 506 may also comprise other processing than the mentioned rectification or envelope detection, for example, an averaging or peak detection, etc. The envelope detector 520 may also be replaced by other processing, such as peak detection, averaging, etc. The amplifying means 524 is used for providing sufficient loop gain in the feedback loop for controlling α. By this feedback, the time constants of the envelope detectors are apparently reduced. However, when the feedback loop is open, i.e., when controlled switches 514 and 516 are not activated to pass signals Lo and Ro, respectively, the time constants appear at their normal value. This may result in a long settling time of the system. Therefore, it may be desirable to decrease the time constants of the envelope detectors when the feedback loop is open, in particular, the time constant of the envelope detector 520. Other methods for deriving α may also be used. For example, the signals Los and Ros may also be used in any combination with the groups A, B and/or C signals for deriving the control signal α therefrom. The control signal α may undergo additional smoothing by incorporating a low-pass filter (not shown) following the amplifier 524 of FIG. 4. In the embodiment of FIG. 3, the control signal α will usually be generated a little late, due to the feedback nature of the generation of the control signal α. If desired, this may be compensated by inserting delays before the amplifier 20. The invention may also be used to increase α by increasing α such that the output signal reaches the level above which the amplification of the amplifier 20 becomes non-linear. In this way, the Incredible Sound effect may be maximized.

Figure 5:
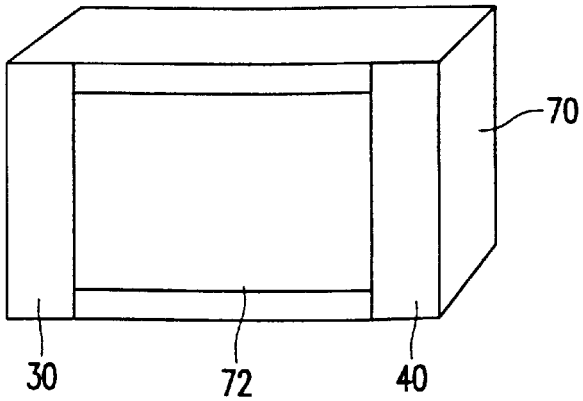
FIG. 5 shows an embodiment for an audio-visual reproduction system in the form of, for example, a television set or a so-called multimedia audio-visual system. In the figures, identical parts are provided with the same reference numbers.

FIG. 5 shows an embodiment for an audio-visual reproduction system in the form of, for example, a television set or a so-called multimedia audio-visual system. The audio-visual reproduction system comprises a cabinet 70 which accommodates a picture display screen 72 for displaying video pictures. To the left of the picture display screen 72 the left channel loudspeaker 30 is positioned. The right channel loudspeaker 40 is positioned to the right of the picture display screen 72. The left channel loudspeaker 30 and the right channel loudspeaker 40 are controlled by the stereophonic audio signal processing arrangement shown in FIG. 2 or 3.

What is claimed is:

1. A stereophonic audio signal processing arrangement comprising:

signal processing means, including a stereo enhancement circuit, for processing a stereo input signal; and signal amplifying means for amplifying a stereo output signal supplied by the signal processing means, said stereo enhancement circuit comprising:

first means having a first and a second input for receiving a left channel and a right channel signal of the stereo input signal, and a first and a second output for supplying a left channel and a right channel signal of a stereo output signal having an enhanced stereo image; and second means for controllably combining the stereo input signal and the stereo output signal of the first means for varying the stereo image enhancement, characterized in that the stereo enhancement circuit further comprises control means coupled to the second means for controlling the combining of the stereo input and output signals so as to reduce the stereo image enhancement at high signal levels; and volume level setting means for supplying a signal representative of a volume level to the amplifying means for setting the volume level, and to the control means for controlling the combining as a function of the set volume level.

2. The arrangement as claimed in claim 1, characterized in that the control means comprises means for comparing a signal level of the stereo output signal having been amplified in said amplifying means with a reference level, and for supplying a control signal to the second means for reducing the stereo image enhancement when the signal level exceeds the reference level.

3. The arrangement as claimed in claim 1, characterized in that the control means comprises means for comparing a signal level of the stereo output signal of the second means with a reference level, and for supplying a control signal to the second means for reducing the stereo image enhancement when the signal level exceeds the reference level.

4. The arrangement as claimed in claim 2, characterized in that the reference level is a function of the set volume level.

5. The arrangement as claimed in claim 1, characterized in that the control signal is only generated if at least one of the left channel and right channel output signals of the second means exceeds the respective left channel or right channel input signal of the first means.

6. A stereophonic audio reproduction system including a stereophonic audio signal processing arrangement comprising:

signal processing means, including a stereo enhancement circuit, for processing a stereo input signal; and signal amplifying means for amplifying a stereo output signal supplied by the signal processing means, said stereo enhancement circuit comprising:

first means having a first and a second input for receiving a left channel and a right channel signal of the stereo input signal, and a first and a second output for supplying a left channel and a right channel signal of a stereo output signal having an enhanced stereo image; and second means for controllably combining the stereo input signal and the stereo output signal of the first means for varying the stereo image enhancement, wherein the stereo enhancement circuit further comprises control means coupled to the second means for controlling the combining of the stereo input and output signals so as to reduce the stereo image enhancement at high signal levels, and volume level setting means for supplying a signal representative of a volume level to the amplifying means for setting the volume level, and to the control means for controlling the combining as a function of the set volume level, said stereophonic audio reproduction system further including left channel and right channel loudspeakers for reproducing the amplified stereo signal supplied by the signal amplifying means.

7. An audio-visual reproduction system including the stereophonic audio reproduction system of claim 6, said audio visual reproduction system further including a cabinet in which a picture display screen and the left channel and right channel loudspeakers are installed.

8. A stereo enhancement circuit comprising:

first means having a first and a second input for receiving a left channel and a right channel signal of the stereo input signal, and a first and a second output for supplying a left channel and a right channel signal of a stereo signal having an enhanced stereo image; and second means for controllably combining the stereo input signal and the stereo output signal of the first means for varying the stereo image enhancement, characterized in that the stereo enhancement circuit further comprises:

control means coupled to the second means for controlling the combining of the stereo signals so as to reduce the stereo image enhancement at high signal levels; and volume level setting means for supplying a signal representative of a volume level to the amplifying means for setting the volume level, and to the control means for controlling the combining as a function of the set volume level.

9. A method for enhancing a stereo image of a stereo input signal, comprising the steps:

generating a stereo output signal having an enhanced stereo image from the stereo input signal; and controllably combining the stereo input signal and the stereo output signal to provide a processed stereo output signal, characterized in that the combining is controlled so as to reduce the stereo image enhancement at high signal levels, and the combining is controlled as a function of a set volume level.

* * * * *